United States Patent [19]

Van Raemdonck et al.

[11] Patent Number: 4,509,785

[45] Date of Patent: Apr. 9, 1985

[54] APPARATUS FOR MOVING AN INDIVIDUAL

[76] Inventors: René Van Raemdonck, Burchtstraat, 17, 9400 Ninove; André Callaert, 4 Septemberdagenlaan, 24, St. Joost-Ten-Noode, both of Belgium

[21] Appl. No.: 494,366

[22] Filed: May 13, 1983

[30] Foreign Application Priority Data

May 13, 1982 [BE] Belgium ..... PV 0/208082

[51] Int. Cl.[3] ..... A47B 83/04

[52] U.S. Cl. ..... 294/118; 294/140; 5/84

[58] Field of Search ..... 294/118, 140; 119/100, 119/102; 5/84, 85, 86, 87, 88, 89, 60, 61, 62

[56] References Cited

U.S. PATENT DOCUMENTS

| | | | |
|---|---|---|---|
| 1,620,298 | 3/1927 | Smith . | |
| 2,743,701 | 5/1956 | Boyd | 294/118 |
| 3,204,954 | 9/1965 | Scannell . | |
| 3,568,226 | 3/1971 | Mater et al. . | |
| 3,597,774 | 8/1971 | Warren | 5/84 |
| 4,159,010 | 6/1979 | Mitro . | |
| 4,256,098 | 3/1981 | Swan et al. . | |

*Primary Examiner*—James B. Marbert

*Attorney, Agent, or Firm*—Watson, Cole, Grindle & Watson

[57] ABSTRACT

There is described an apparatus for moving an individual, which is comprised of two arms bearing supporting members, which are so shaped as to grip the individual to be moved underneath the armpits and sidewise partly about the thorax.

7 Claims, 2 Drawing Figures

APPARATUS FOR MOVING AN INDIVIDUAL

This invention relates to an apparatus for moving an individual. With the wording "individual" is meant as well a patient, such as a motionally-handicapped individual for instance, as an individual whose movements are temporarily hindered.

The object of the invention is to provide an apparatus which secures a very good prop or support for an individual who either has to be moved from a lying or sitting position to a vertical position, or who is temporarily hindered in his movements and who should also be moved to a vertical position.

Moving a bed-confined individual or a motionally-handicapped individual brings a number of problems both when such individual has to leave his horizontal position as when such a patient has to be moved in vertical position. In the same way, moving a temporarily-hindered individual may not always be made without the help of more than one attendant or nurse.

The invention has for object to provide an apparatus which brings an original solution to the above-defined problems.

For this purpose the apparatus according to the invention is comprised of two arms bearing supporting members which are so shaped as to grip the individual to be moved underneath the armpits and partly sidewise about his thorax.

In an advantageous embodiment of the invention, said arms are hingedly connected together scissor-like, and they are connected with those ends thereof which are to be considered as the upper ends in operating condition, to members which are raisable, in such a way that said members are moved towards one another under the action of the weight of the individual to be moved.

In another embodiment, said arms are part of elements which may be brought towards one another with mechanical means.

Other details and advantages of the invention will stand out from the following description, given by way of non limitative example and with reference to the accompanying drawings, in which.

Figure 1:
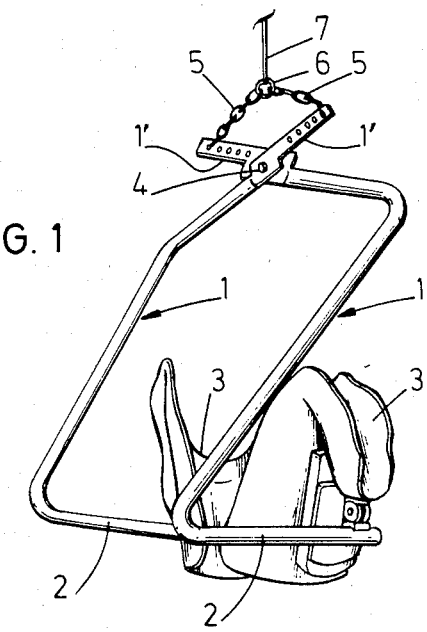
FIG. 1 is a perspective showing of an apparatus for moving an individual according to the invention.

The apparatus as shown in both figures forms a possible embodiment of the invention, which is essentially comprised of two elements 1 hingedly connected together scissor-like, elements 1 the arms 2 of which are provided with supporting members 3 which are so shaped as to grip the individual to be moved underneath the armpits and partly about the thorax.

Said elements 1 are hingedly connected together in 4. Those portions 1' from elements 1 which lie beyond the hinge point 4, are connected through chains or cables 5 to a rolling member, such as a pulley, not shown in the figures.

Said chains or cables 5 may be connected directly to said movable member, or be first connected to a metal ring 6 which is in turn connected by a cable or chain 7 to said pulley.

Such latter solution is to be preferred as the apparatus is then raised from a single cable or chain, that is element 7 in this case.

As it appears from the figures, the supporting members 3 may be made from a suitable material such as for example, polyester and they are so shaped on the one hand, as to grip the individual to be moved underneath the armpits, and on the other hand as to bear in the closing position of the apparatus, sidewise and tightly against the individual's thorax. When the apparatus is raised, the elements 1 and thus also the arms 2 try to come closer to one another. The individual who uses the apparatus to move about, thus feels perfectly supported without any discomfort.

In some cases, the supporting members 3 may further be provided with bearing plates 8. Said additional components have for advantage to allow the perfect raising of bed-confined individuals from the horizontal position to the vertical position, without the operator of the apparatus, usually a nurse, having to impart an additional force.

Said elements 1 when considering the apparatus in operating condition, are folded frontwards in such a way that those arms 2 which comprise part of said elements 1, lie in operating condition, perfectly horizontally. A lying or sitting patient is thus always approached from the front.

Figure 2:
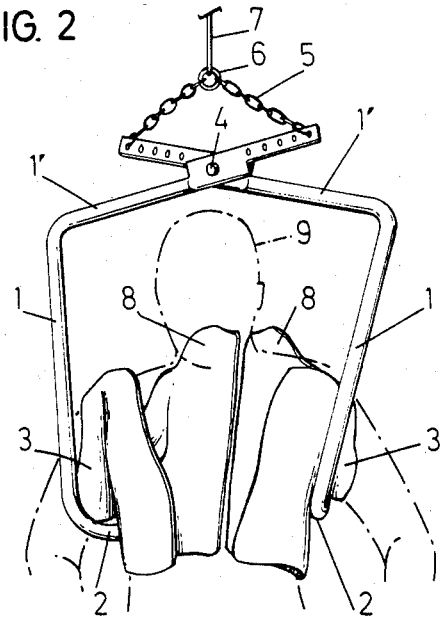
FIG. 2 shows also in a perspective showing and in operating condition, an apparatus according to the invention.

The front-directed arms 2 have the further advantage that the individual 9 (FIG. 2) can use his arms to obtain an additional bearing.

Even if the invention has been described with reference to an example in which the elements 1 are hingedly connected scissor-like, said elements 1 might be brought closer in any other way as an individual bears on the supporting members 3.

For instance, the chains or cables 5 might be replaced by non-flexible elements.

The apparatus suspension also might undergo substantial changes. The apparatus may be caused to roll along a rail or be pulled along a cable. In this latter case, the apparatus may be used for sea-rescue.

Moreover the scissor principle which uses the weight of the individual to be moved, may also be replaced by any system in which either due to the individual's weight, or independently thereof, the supporting elements 3 are brought nearer one another by mechanical means.

Finally the apparatus may further be provided with one or two leg supports.

It must be understood that the invention is not limited to the above embodiments and that many changes may be brought thereto without departing from the scope of the invention as defined by the appended claims.

We claim:

1. Apparatus for moving an individual, the apparatus comprising two elements which are each bent to form an arm portion, the arm portions being essentially parallel to each other, said arm portions each bearing supporting members shaped so as to grip the individual to be moved underneath the armpits and sidewise partly about the thorax, and means for connecting the elements such that the arm portions are moved toward one another under the action of the individual's weight.

2. Apparatus as defined in claim 1, in which said elements are bent at right angles to form said arm portions.

3. Apparatus as defined in claim 1, in which said supporting members further cooperate with plates which act as additional bearing for the individual to be moved.

4. Apparatus as defined in claim 1 in which the means for connecting the elements comprise a hinge connecting the elements in a scissor-like manner.

5. Apparatus as defined in claim 4 in which a flexible member is attached to the end of each element remote from the arm portions.

6. Apparatus as defined in claim 5 in which the flexible members are attached to a ring.

7. Apparatus as defined in claim 1 in which the means for connecting the elements comprise mechanical means.

* * * * *